US007534311B2

(12) United States Patent
Tomizawa et al.

(10) Patent No.: US 7,534,311 B2
(45) Date of Patent: May 19, 2009

(54) R-T-B SINTERED MAGNET AND RARE EARTH ALLOY

(75) Inventors: Hiroyuki Tomizawa, Osaka (JP); Yutaka Matsuura, Kyoto (JP)

(73) Assignee: Hitachi Metals, Ltd., Tokyo (JP)

( * ) Notice: Subject to any disclaimer, the term of this patent is extended or adjusted under 35 U.S.C. 154(b) by 255 days.

(21) Appl. No.: 10/567,502

(22) PCT Filed: Aug. 10, 2004

(86) PCT No.: PCT/JP2004/011743

§ 371 (c)(1),
(2), (4) Date: Feb. 7, 2006

(87) PCT Pub. No.: WO2005/015580

PCT Pub. Date: Feb. 17, 2005

(65) Prior Publication Data

US 2006/0201585 A1 Sep. 14, 2006

(30) Foreign Application Priority Data

Aug. 12, 2003 (JP) ..... 2003-292194

(51) Int. Cl.
*H01F 1/08* (2006.01)

(52) U.S. Cl. ..... 148/302; 75/244

(58) Field of Classification Search ..... None
See application file for complete search history.

(56) References Cited

U.S. PATENT DOCUMENTS 4,770,723 A 9/1988 Sagawa et al.
4,792,368 A 12/1988 Sagawa et al.
4,935,075 A 6/1990 Mizoguchi et al.

(Continued)

FOREIGN PATENT DOCUMENTS

JP 61-295355 12/1986

(Continued)

OTHER PUBLICATIONS

International Search Report mailed Oct. 19, 2004 for PCT Application No. PCT/JP2004/011743.

(Continued)

*Primary Examiner*—John P. Sheehan
(74) *Attorney, Agent, or Firm*—Keating & Bennett, LLP

(57) ABSTRACT

A rare-earth sintered magnet according to the present invention, of which the main phase is an $R_2T_{14}B$ type compound phase, includes: 27 mass % through 32 mass % of R, which is at least one rare-earth element that is selected from the group consisting of Nd, Pr, Tb, and Dy and that always includes at least one of Nd and Pr; 60 mass % through 73 mass % of T, which is either Fe alone or a mixture of Fe and Co; 0.85 mass % through 0.98 mass % of Q, which is either B alone or a mixture of B and C and which is converted-into B on a number of atoms basis when its mass percentage is calculated; more than 0 mass % through 0.3 mass % of Zr; at most 2.0 mass % of an additive element M, which is at least one element selected from the group consisting of Al, Cu, Ga, In and Sn; and inevitably contained impurities.

8 Claims, 10 Drawing Sheets

U.S. PATENT DOCUMENTS

| | | | | |
|---|---|---|---|---|
| 5,223,047 | A | 6/1993 | Endoh et al. | |
| 5,314,548 | A | 5/1994 | Panchanathan et al. | |
| 5,472,525 | A | 12/1995 | Tokunaga et al. | |
| 5,858,123 | A | 1/1999 | Uchida et al. | |
| 6,468,365 | B1 | 10/2002 | Uchida et al. | |
| 2002/0007875 | A1 | 1/2002 | Yamamoto et al. | |
| 2004/0118484 | A1* | 6/2004 | Nishizawa et al. | 148/302 |
| 2004/0166013 | A1* | 8/2004 | Nishizawa et al. | 419/12 |
| 2004/0177899 | A1* | 9/2004 | Nishizawa et al. | 148/302 |
| 2004/0187962 | A1* | 9/2004 | Ishizaka et al. | 148/101 |
| 2004/0187970 | A1* | 9/2004 | Ishizaka et al. | 148/302 |
| 2004/0189426 | A1* | 9/2004 | Hidaka et al. | 335/202 |
| 2004/0216811 | A1* | 11/2004 | Ikegami | 148/105 |
| 2005/0268989 | A1 | 12/2005 | Tomizawa et al. | |

FOREIGN PATENT DOCUMENTS

| | | |
|---|---|---|
| JP | 04-165012 | 6/1992 |
| JP | 06-104108 | 4/1994 |
| JP | 06-220502 | 8/1994 |
| JP | 06-231926 | 8/1994 |
| JP | 09-283313 | 10/1997 |
| JP | 10-097908 | 4/1998 |
| JP | 10-289813 | 10/1998 |
| JP | 2000-188213 | 7/2000 |
| JP | 2001-297907 | 10/2001 |
| JP | 2002-038245 | 2/2002 |
| JP | 2002-064010 | 2/2002 |
| JP | 2002-75717 | 3/2002 |
| JP | 2002-285276 | 10/2002 |

OTHER PUBLICATIONS

International Search Report issued in the corresponding International Application No. PCT/JP2004/011743, mailed on May 18, 2006.

* cited by examiner

50μm/div

50μm/div

50μm/div

50μm/div

50μm/div

50μm/div 5.5 μm 5.5 μm 5.5 μm 5.5 μm 5.5 μm 8.5 μm

R-T-B SINTERED MAGNET AND RARE EARTH ALLOY

BACKGROUND OF THE INVENTION

1. Field of the Invention

The present invention relates to an R-T-B based sintered magnet and a rare-earth alloy as its material.

2. Description of the Related Art

An R-T-B based sintered magnet, one of the most prominent high-performance permanent magnets (which is sometimes called a "neodymium-iron-boron-based sintered magnet"), has excellent magnetic properties, and is used in motors, actuators, and various other applications.

An R-T-B based sintered magnet is comprised of a main phase consisting essentially of a compound with an $R_2Fe_{14}B$ type crystal structure (i.e., $R_2Fe_{14}B$ compound phase), an R-rich phase and a B-rich phase. Basic compositions of R-T-B based sintered magnets are disclosed, for example, in U.S. Pat. Nos. 4,770,723 and 4,792,368, the entire disclosures of which are hereby incorporated by reference. An R-T-B based sintered magnet has a higher maximum energy product than any of various other magnets, but is expected to have its performance (in remanence, among other things) further improved. For instance, even just 1% increase in remanence should have an immense industrial value.

To increase the remanence of a sintered magnet, the density of the sintered magnet (which will be sometimes referred to herein as a "sintered density") needs to be as close to its true density as possible. However, if the sintering process is carried out either at a higher temperature or for a longer time to increase the density of an R-T-B based sintered magnet, then the sintered density will increase but the crystal grains thereof will have excessively big sizes to cause a decrease in coercivity, which is a problem. Particularly if an "abnormal grain growth" occurred to produce giant crystal grains (main phases) locally, then the square ratio Hk/HcJ of the demagnetization curve would decrease so much as to cause various inconveniences when such a magnet is actually used.

That is to say, in the prior art, it is difficult to increase the sintered density of an R-T-B based sintered magnet without sacrificing its coercivity. Also, even if sintering conditions that would contribute to striking an adequate balance in resultant performance could be found, their margins should be too narrow to manufacture R-T-B based sintered magnets with excellent performance constantly on an industrial basis.

Japanese Patent Application Laid-Open Publications No. 61-295355 and No. 2002-75717 disclose techniques of suppressing the abnormal grain growth by nucleating a boride on a gain boundary with the addition of Ti, Zr or any other element that produces the boride. According to the methods disclosed in Japanese Patent Application Laid-Open Publications No. 61-295355 and No. 2002-75717, the sintered density can be increased with the excessive increase in crystal grain size avoided (i.e., with the decrease in coercivity minimized).

According to the methods disclosed in Japanese Patent Application Laid-Open Publications No. 61-295355 and No. 2002-75717, however, a boride phase with no magnetic force (i.e., B-rich phase) is present in the sintered magnet, and the main phase that produces the magnetism (i.e., $R_2T_{14}B$ type compound phase) has a decreased volume percentage, thus resulting in decreased remanence.

SUMMARY OF THE INVENTION

In order to overcome the problems described above, an object of the present invention is to provide an R-T-B based sintered magnet of which the remanence is increased by minimizing both the decrease in coercivity and the decrease in the volume percentage of its main phase.

A rare-earth sintered magnet according to the present invention, of which the main phase includes an $R_2T_{14}B$ type compound phase, includes: 27 mass % through 32 mass % of R, which is at least one rare-earth element that is selected from the group consisting of Nd, Pr, Tb, and Dy and that always includes at least one of Nd and Pr; 60 mass % through 73 mass % of T, which is either Fe alone or a mixture of Fe and Co; 0.85 mass % through 0.98 mass % of Q, which is either B alone or a mixture of B and C and which is converted into B on a number of atoms basis when its mass percentage is calculated; more than 0 mass % through 0.3 mass % of Zr; at most 2.0 mass % of an additive element M, which is at least one element selected from the group consisting of Al, Cu, Ga, In and Sn; and inevitably contained impurities.

In one preferred embodiment, the magnet includes substantially no accumulated phases of Q.

In another preferred embodiment, the additive element includes Ga, which accounts for 0.01 mass % through 0.08 mass % of the magnet.

In another preferred embodiment, the magnet includes at most 0.95 mass % of Q.

In another preferred embodiment, the magnet includes at least 0.90 mass % of Q.

In another preferred embodiment, the magnet has a square ratio Hk/HcJ of at least 0.9 in its demagnetization curve.

A rare-earth alloy according to the present invention is a material alloy for a rare-earth sintered magnet, a main phase of which includes an $R_2T_{14}B$ type compound phase. The alloy includes: 27 mass % through 32 mass % of R, which is at least one rare-earth element that is selected from the group consisting of Nd, Pr, Tb, and Dy and that always includes at least one of Nd and Pr; 60 mass % through 73 mass % of T, which is either Fe alone or a mixture of Fe and Co; 0.85 mass % through 0.98 mass % of Q, which is either B alone or a mixture of B and C; more than 0 mass % through 0.3 mass % of Zr; at most 2.0 mass % of an additive element M, which is at least one element selected from the group consisting of Al, Cu, Ga, In and Sn; and inevitably contained impurities.

In one preferred embodiment, the alloy includes substantially no accumulated phases of Q.

In another preferred embodiment, the additive element includes Ga, which accounts for 0.01 mass % through 0.08 mass % of the magnet.

In another preferred embodiment, the alloy includes at most 0.95 mass % of Q.

According to the present invention, the abnormal grain growth can be suppressed without producing any boride phase. As a result, an R-T-B based sintered magnet can be obtained with the decreased in coercivity minimized and with the remanence increased.

DETAILED DESCRIPTION OF PREFERRED EMODIMENTS

Figure 1:
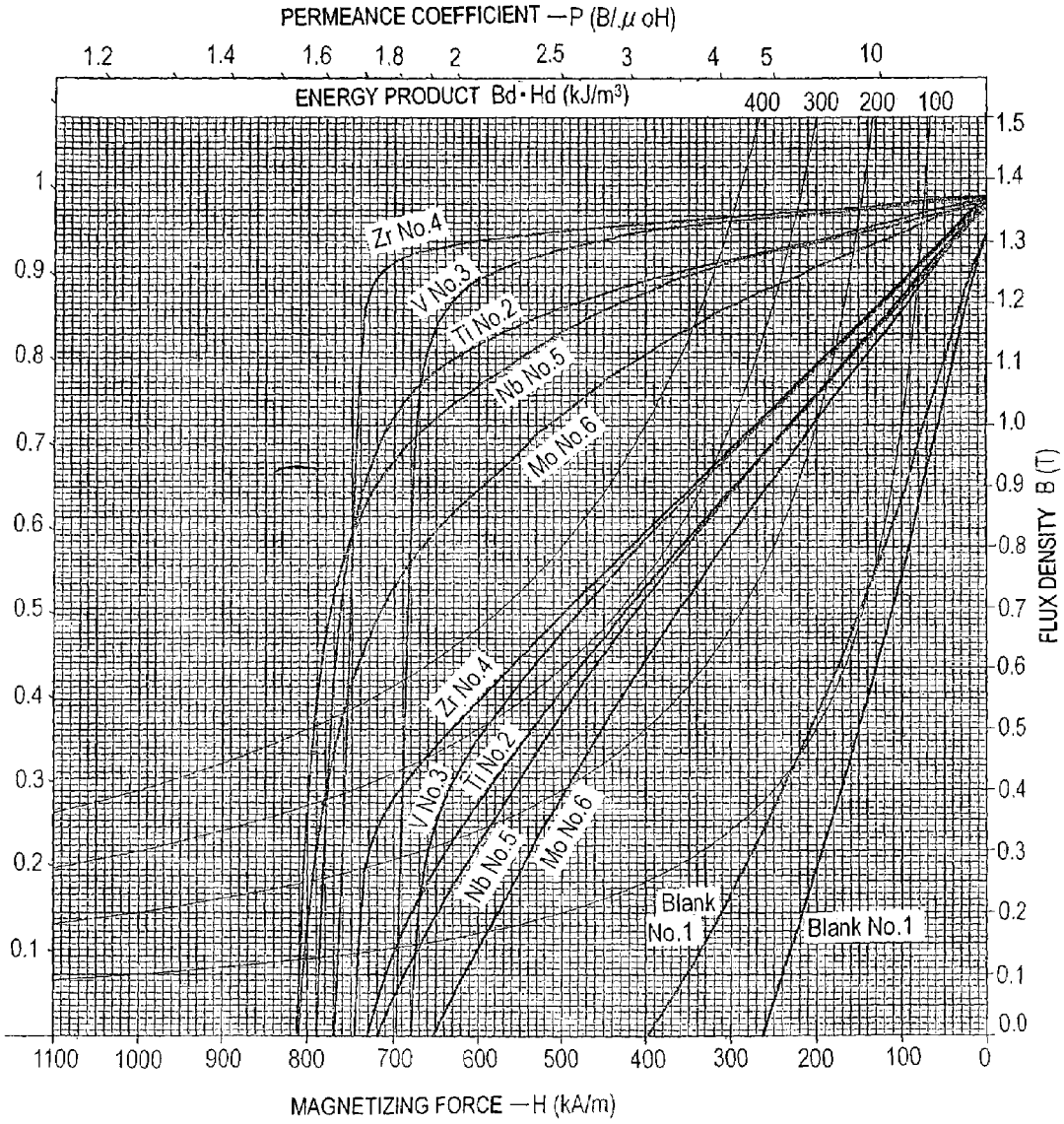
FIG. 1 is a graph showing the demagnetization curves of Samples Nos. 1 through 6.

The present inventors discovered that when 0.3 mass % or less of Zr was added to an $R_2T_{14}B$ based rare-earth sintered magnet including at most 0.98 mass % of B, the abnormal grain growth could be suppressed without producing any boride phase, thus acquiring the basic idea of the present invention.

An $R_2T_{14}B$ based rare-earth sintered magnet according to a preferred embodiment of the present invention includes: 27 mass % through 32 mass % of R, which is at least one rare-earth element that is selected from the group consisting of Nd, Pr, Tb, and Dy and that always includes at least one of Nd and Pr; 60 mass % through 73 mass % of T, which is either Fe alone or a mixture of Fe and Co; 0.85 mass % through 0.98 mass % of B; more than 0 mass % through 0.3 mass % of Zr; at most 2.0 mass % of an additive element M, which is at least one element selected from the group consisting of Al, Cu, Ga, In and Sn; and inevitably contained impurities.

R is at least one rare-earth element that is selected from the group consisting of Nd, Pr, Dy and Tb and that always includes at least one of Nd and Pr. Preferably, a combination of rare-earth elements such as Nd—Dy, Nd—Tb, Nd—Pr—Dy or Nd—Pr—Tb is used. Among these rare-earth elements, Dy and Tb are particularly effective in increasing the coercivity. Also, R does not have to be a pure element but may include some impurities, which should be inevitably contained during every manufacturing process, as long as such a non-pure rare-earth element is easily available on an industrial basis. If the mass fraction of R were less than 27 mass %, high magnetic properties (or high coercivity among other things) could not be realized. However, if the mass fraction exceeded 32 mass %, then the remanence would decrease. That is why the mass fraction of R is preferably 27 mass % through 32 mass %.

T always includes Fe, a portion (preferably, at most 50%) of which may be replaced with Co. T may also include small amounts of transition metal elements other than Fe and Co. The addition of Co is effective in improving the temperature characteristic and corrosion resistance. Normally, 10 mass % or less of Co and Fe as the balance are used, in combination. If the mass fraction of T were less than 60 mass %, then the remanence would decrease. Nevertheless, if the mass fraction of T exceeded 73 mass %, then the coercivity would decrease. In view of these considerations, the mass fraction of T is preferably 60 mass % through 73 mass %.

Zr is an essential element in the present invention. As will be described later by way of experimental examples, Zr achieves unique effects. Zr replaces rare-earth sites of the main phase, makes a solid solution, and slows down the crystal growth rate, thereby suppressing the abnormal grain growth. As disclosed in Japanese Patent Application Laid-Open Publications No. 61-295355 and No. 2002-75717, in the prior art, they believe that a boride is indispensable in order to suppress the abnormal grain growth. Contrary to this common knowledge in the prior art, the present inventors discovered that the abnormal grain growth could be suppressed even without nucleating any boride. Specifically, by adding Zr, the sintering process can be carried out even at a temperature and/or for an amount of time, which would cause the abnormal grain growth according to a conventional composition, without nucleating any boride phase that would decrease the remanence, and the sintered density can be increased while maintaining the microcrystalline structure. According to a preferred embodiment of the present invention, a magnet in which a main phase having a tetragonal $R_2T_{14}B$ type crystal structure accounts for 90% or more of the overall volume and which includes substantially no B-rich phases (Q accumulated phase: R1.1Fe4B4 phase, for example), can be obtained.

As used herein, if the magnet "includes substantially no B-rich phases", it means that when randomly picked 10 or more portions of the magnet are observed with an EPMA, no Q accumulated structure is identified in 90% or more of those portions. Also, if "no Q accumulated phase is identified", then the total area of a portion where bright spots are concentrated (i.e., a portion attributed to an accumulated phase) is less than 5% of the overall vision of 100 μm×100 μm when the fluorescence x-rays (B-Kα) of born (B) are observed with an EPMA (e.g., EPM1610 produced by Shimadzu Corporation) under the conditions including an acceleration voltage of 15 kV, a beam diameter of 1 μm, a current value of 30 nA (measured with a Faraday cup) and spectral crystals of LSA200.

However, once the Zr mass fraction exceeds 0.3 mass %, the remanence decreases. That is why the Zr mass fraction is preferably 0.3 mass % or less. Also, if there is an excessive amount of B, then a boride phase is produced. Accordingly, to minimize the production of such boride phases, the B mass fraction is set to 0.98 mass % or less. Furthermore, a portion of B may be replaced with C. When either B alone or a mixture of B and C is identified by Q, C that replaces a portion of B may be converted into B on a number of atoms basis when the mass percentage of Q is calculated.

The additive element M is at least one element selected from the group consisting of Al, Cu, Ga, In and Sn. M is preferably added at 2.0 mass % or less. This is because the remanence decreases once the mass fraction of M exceeds 2.0 mass %.

Among these additive elements, Ga may achieve unique effects. As will be described later by way of experimental examples, if the mass fraction of B (or Q) is low, then a soft magnetic $R_2T_{17}$ compound may be produced to decrease coercivity and remanence in some cases. By adding an extremely small amount of Ga to such a composition range, the production of the soft magnetic phase is minimized, thus realizing a rare-earth sintered magnet that exhibits high coercivity and high remanence in a broad B mass fraction range. The present invention is particularly effective in a situation where B is added at 0.98 mass % or less to cut down the production of Zr borides.

The effects achieved by adding Ga are noticeable if the mass fraction of B (or Q) is 0.95 mass % or less and 0.90 mass % or more. Also, if the Ga mass fraction is less than 0.01 mass %, those effects may not be achieved and it may be difficult to perform analytical control. Nevertheless, the Ga mass fraction should not exceed 0.08 mass % because the remanence Br might drop at such a high Ga mass fraction.

According to the present invention, not only the elements mentioned above but also other inevitably contained impurities may be included as well. Examples of those impurities include Mn and Cr coming from the material of Fe, Al and Si coming from Fe—B (ferroboron), and H, N and O that should be inevitably used in any manufacturing process.

Also, the resultant sintered magnet preferably includes at most 0.5 mass % of oxygen, at most 0.2 mass % of nitrogen and at most 0.01 mass % of hydrogen. By setting the upper limits of these oxygen, nitrogen and hydrogen concentrations in this manner, the percentage of the main phase can be increased, whereby the remanence Br can be increased.

An R-T-B based sintered magnet according to a preferred embodiment of the present invention may be produced by a known method. For example, the magnet may be made by the following process.

First, a melt of a mother alloy having a predetermined composition is prepared by an induction melting process, for example, and then cooled and solidified to make a (mother) alloy. The composition of the mother alloy is controlled such that the resultant rare-earth sintered magnet will have the composition described above. The (mother) alloy may be made by a known normal method. Among various methods of making an alloy, a rapid cooling process such as a strip casting process is used particularly effectively. According to a strip casting process, cast flakes with a thickness of about 0.1 mm to about 5 mm, for example, can be obtained.

Optionally, a centrifugal casting process may be adopted instead of the rapid cooling process such as a strip casting process. Also, the alloy may be made by performing a direct reduction-diffusion process instead of the melting/alloying process step. Similar effects are achievable even if a solidified alloy, made by a non-rapid cooling process, is used as the mother alloy. Compared to a rapid cooling process such as a strip casting process, however, segregation would be produced more easily, and therefore, a Zr boride might nucleate in the alloy structure to make it difficult to add Zr efficiently. Furthermore, once such a Zr boride has nucleated, that Zr boride is hard to remove through a thermal treatment and will remain even after the sintering process. Accordingly, compared to a situation where the rapidly solidified alloy is used, a sintered magnet made from such a solidified alloy is more likely to have a main phase with a decreased volume percentage and may eventually have decreased remanence Br.

The resultant alloy is pulverized by a known method to a mean particle size of 1 μm to 10 μm. Such an alloy powder is preferably obtained by performing two types of pulverization processes, namely, a coarse pulverization process and a fine pulverization process. The coarse pulverization may be done by a hydrogen decrepitation process or a mechanical grinding process using a disk mill, for example. On the other hand, the fine pulverization may be done by a mechanical grinding process using a jet mill, a ball mill or an attritor, for example.

The finely pulverized powder obtained by the pulverization processes described above is compacted into any of various shapes by a known compacting technique. The compaction is normally carried out by compressing the powder under a magnetic field. Alternatively, after the powder has been aligned with a pulse magnetic field, the powder may be compacted under an isostatic pressure or within a rubber mold.

To feed the powder more efficiently during the compaction process, make the green density more uniform, and release the compact from the mold more easily, a liquid lubricant such as a fatty acid ester or a solid lubricant such as zinc stearate may be added to the powder yet to be finely pulverized and/or the finely pulverized powder. The lubricant is preferably added in 0.01 to 5 parts by weight with respect to the alloy powder of 100 parts by weight.

The green compact may be sintered by a known method. The sintering process is preferably carried out at a temperature of 1,000° C. to 1,180° C. for approximately one to six hours. An alloy according to a preferred embodiment of the present invention can be sintered at a higher temperature than a conventional alloy thanks to the addition of Zr. Thus, a sintering temperature of 1,100° C. or more, which is hard to adopt for mass production in the prior art considering possible variations in temperature, can be adopted according to the present invention. The sintered compact is subjected to a heat treatment (aging treatment) if necessary. The heat treatment is preferably carried out at a temperature of 400° C. to 600° C. for approximately one to eight hours.

Hereinafter, the present invention will be described more fully by way of experimental examples.

EXPERIMENTAL EXAMPLE NO. 1

Magnets having the compositions shown in Table 1 were made in the following manner as Samples Nos. 1 through 6, respectively. It should be noted that the compositions shown in Table 1 are values obtained by analyzing the resultant sintered magnets, not the compositions of the mother alloys.

TABLE 1

| Sample | Nd | Fe | Co | Al | Cu | Ga | M | B | O | C | N |
|---|---|---|---|---|---|---|---|---|---|---|---|
| No. 1 | 29.5 | Bal. | 0.88 | 0.15 | 0.10 | 0.00 | 0.00 | 0.95 | 0.39 | 0.05 | 0.010 |
| No. 2 | 29.7 | Bal. | 0.89 | 0.15 | 0.10 | 0.03 | Ti: 0.10 | 0.95 | 0.40 | 0.05 | 0.008 |
| No. 3 | 29.6 | Bal. | 0.88 | 0.16 | 0.10 | 0.03 | V: 0.10 | 0.94 | 0.40 | 0.06 | 0.009 |
| No. 4 | 29.6 | Bal. | 0.88 | 0.15 | 0.10 | 0.03 | Zr: 0.10 | 0.95 | 0.38 | 0.05 | 0.008 |
| No. 5 | 29.7 | Bal. | 0.90 | 0.15 | 0.10 | 0.03 | Nb: 0.10 | 0.95 | 0.39 | 0.05 | 0.010 |
| No. 6 | 29.7 | Bal. | 0.89 | 0.15 | 0.10 | 0.03 | Mo: 0.10 | 0.95 | 0.39 | 0.06 | 0.010 |

(unit: mass %)

The composition analysis was carried out by a known method using an ICP produced by Shimadzu Corporation and a gas analyzer produced by Horiba, Ltd.

In Table 1, Fe is shown as the balance. Actually, however, the balance includes Fe and very small amounts of inevitably contained impurities. The same statement will apply to Table 3 to be mentioned later.

In each of the samples representing this experimental example, the mass fraction of B substantially agrees with its stoichiometric ratio defined with respect to the mass fractions of R and T. Also, calculating the volume percentages of the respective phases with the additive element M taken out of consideration, the main phase (e.g., $Nd_2Fe_{14}B$ compound phase) has a volume percentage of 94.4%, the R-rich phase has a volume percentage of 2.5%, the B-rich phase has a volume percentage of 0.1% and the R-oxide phase ($Nd_2O_3$) has a volume percentage of 3.0%.

A melt of a mother alloy with a predetermined composition was prepared and then subjected to a strip casting process, thereby making alloy cast flakes with thicknesses of about 0.2 mm to about 0.4 mm.

The alloy cast flakes thus obtained were held within a hydrogen atmosphere at a normal temperature and under an absolute pressure of 0.2 MPa for two hours, thereby getting hydrogen absorbed into the alloy.

Next, the hydrogen-absorbed alloy was held within a vacuum at about 600° C. for three hours and then cooled to room temperature.

The resultant alloy had been broken due to hydrogen decrepitation. This alloy was sieved and crushed, thereby obtaining a coarsely pulverized powder with a particle size of 425 μm or less.

Then, the coarsely pulverized powder obtained in this manner was finely pulverized within a nitrogen gas atmosphere using a jet mill pulverizer. In each of the samples, the powder had a mean particle size of 3.2 μm to 3.5 μm as measured by FSSS.

A compact was made by pressing the powder thus obtained. In this case, the compaction process was carried out at a pressure of 196 MPa with a transverse magnetic field (orthogonal to the press direction) of about 1 T (tesla) applied thereto.

The green compact thus obtained was sintered under various temperature conditions for approximately 2 hours, thereby making a sintered compact.

The resultant sintered compact was subjected to an aging treatment within an Ar atmosphere at 550° C. for two hours, thereby obtaining each sample of the sintered magnet. Then, the magnetic properties of the magnet were evaluated.

Thereafter, the magnet was further thermally demagnetized within an inert atmosphere at 400° C. and then subjected to a metallographic structure analysis and a chemical analysis.

FIG. 1 shows the demagnetization curves of the respective samples. In this case, each sample used was sintered at 1,120° C. for two hours.

As is clear from the results shown in FIG. 1, Sample No. 1 including no additive element M showed very bad squareness. This is because the sintering temperature of 1,120° C. was too high for Sample No. 1 to avoid the abnormal grain growth as will be described later. Each of Samples Nos. 2, 3, 5 and 6, to which Ti, V, Nb and Mo were added as respective additive elements M, showed squareness that was better than Sample No. 1 but worse than Sample No. 4 to which Zr was added. The demagnetization curve of Sample No. 4 showed excellent squareness. Thus, it can be seen that Zr achieved unique effects.

Figure 2:
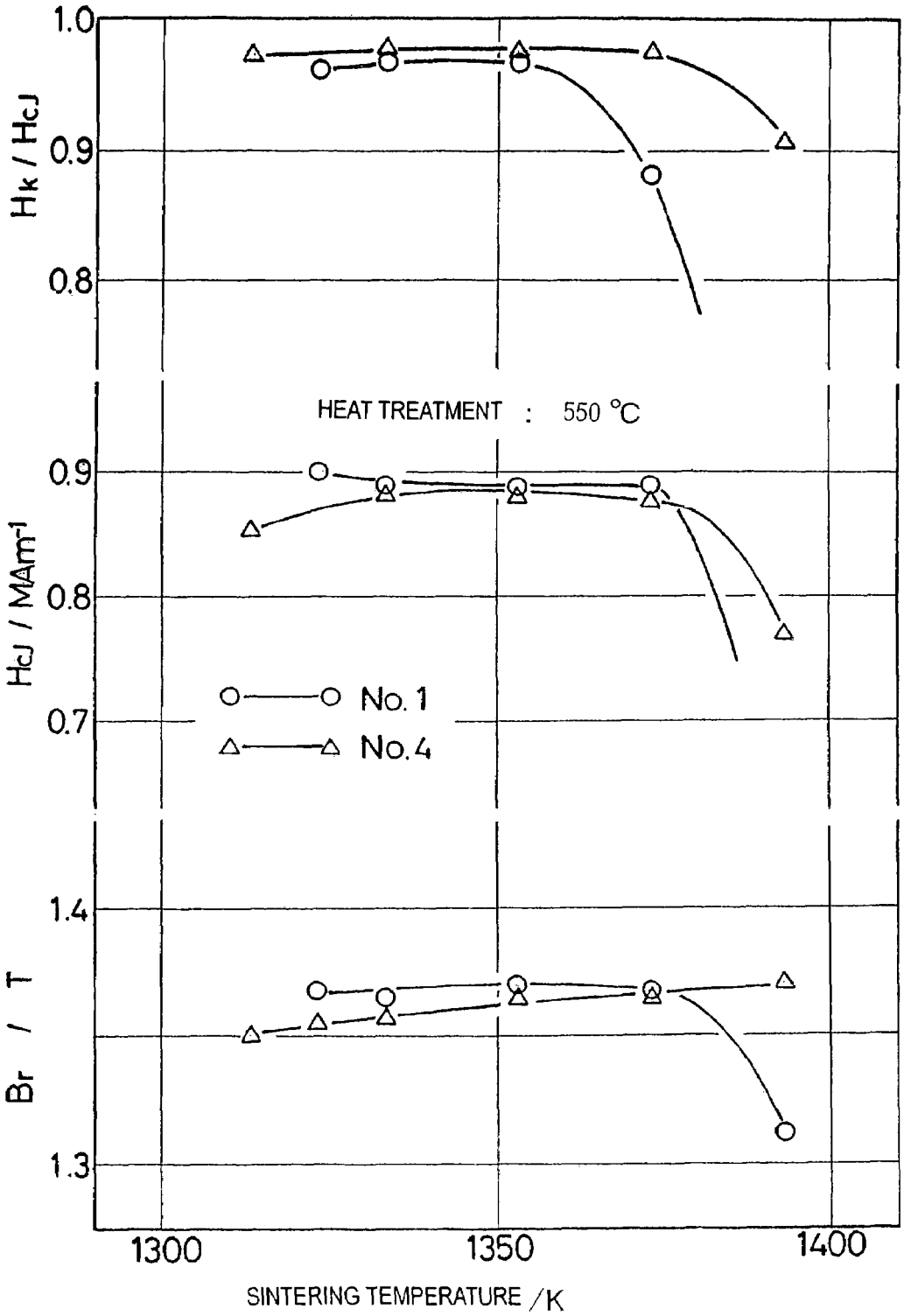
FIG. 2 is a graph showing how the magnetic properties of Samples Nos. 1 and 4 changed with the sintering temperature.

Next, it will be described with reference to FIG. 2 how the magnetic properties of Samples Nos. 1 and 4 changed with the sintering temperature. FIG. 2 is a graph of which the abscissa represents the sintering temperature and the ordinate represents the square ratio Hk/HcJ, coercivity HcJ and remanence Br in this order downward. In the square ratio Hk/HcJ used in this example as an index to squareness, Hk represents the value of an external magnetic field when the magnetization becomes 90% of the remanence Br. As can be seen from the graph shown in FIG. 2, the upper limit of the sintering temperature range resulting in good magnetic properties increased in Sample No. 4 with the additive Zr (as plotted with Δ in FIG. 2) by about 20° C. as compared with Sample No. 1 including no additive elements at all. As a result, even if the sintering temperature was set to 1,120° C. (=1, 393 K), the square ratio was still more than 0.9, showing that Sample No. 4 had excellent squareness.

Next, the relationship between the sintering temperature and the squareness and abnormal grain growth will be described with reference to Table 2. In the size (particle size) columns of Table 2, the open circle ○ represents that no abnormal grain growth occurred, while the cross x represents that the abnormal grain growth occurred. As can be seen from Table 2, Sample No. 1 including no additive elements caused the abnormal grain growth at as low as 1,100° C. and had a low square ratio Hk/HcJ. In contrast, Sample No. 4 including an additive Zr caused no abnormal grain growth even at 1,120° C. and had a square ratio as high as 0.9 or more. Also, as can be seen from the results of Samples Nos. 2, 3, 5 and 6, each of the other additive elements (i.e., Ti, V, Nb and Mo) achieved the effects of suppressing the abnormal grain growth and maintaining a high square ratio as long as the sintering temperature was up to 1,100° C. However, looking at the results at 1,120° C., it is clear that their effects were not so significant as those achieved by Zr.

TABLE 2

| | 1,040° C. | | 1,060° C. | | 1,080° C. | | 1,100° C. | | 1,120° C. | |
|---|---|---|---|---|---|---|---|---|---|---|
| Sample | Size | Hk/HcJ | Size | Hk/HcJ | Size | Hk/HcJ | Size | Hk/HcJ | Size | Hk/HcJ |
| No. 1 | ○ | 0.966 | ○ | 0.967 | ○ | 0.965 | x | 0.880 | x | 0.086 |
| No. 2 | ○ | 0.977 | ○ | 0.978 | ○ | 0.975 | ○ | 0.975 | x | 0.529 |
| No. 3 | ○ | 0.968 | ○ | 0.961 | ○ | 0.970 | ○ | 0.962 | x | 0.871 |
| No. 4 | ○ | 0.972 | ○ | 0.969 | ○ | 0.972 | ○ | 0.979 | ○ | 0.908 |
| No. 5 | ○ | 0.974 | ○ | 0.980 | ○ | 0.972 | ○ | 0.967 | x | 0.488 |
| No. 6 | ○ | 0.974 | ○ | 0.982 | ○ | 0.979 | ○ | 0.975 | x | 0.307 |

Legends:
in size (particle size), ○ represents that no abnormal grain growth occurred and x represents that abnormal grain growth occurred.

Figure 3:
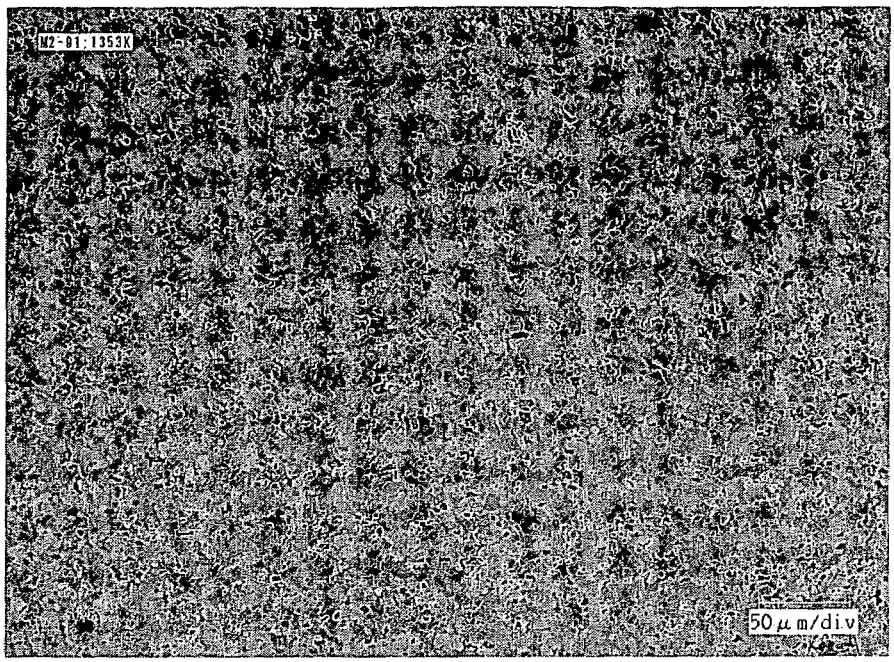
FIG. 3 is a photograph showing the metallographic structure of Sample No. 1 that had been sintered at 1,080° C. and then looked at through a polarizing microscope.
Figure 4:
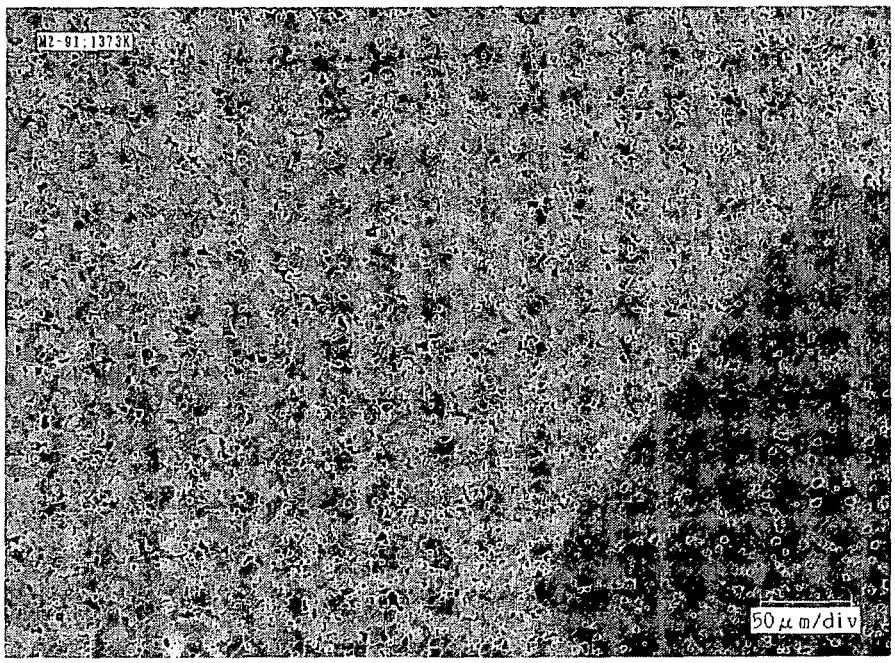
FIG. 4 is a photograph showing the metallographic structure of Sample No. 1 that had been sintered at 1,100° C. and then looked at through a polarizing microscope.
Figure 5:
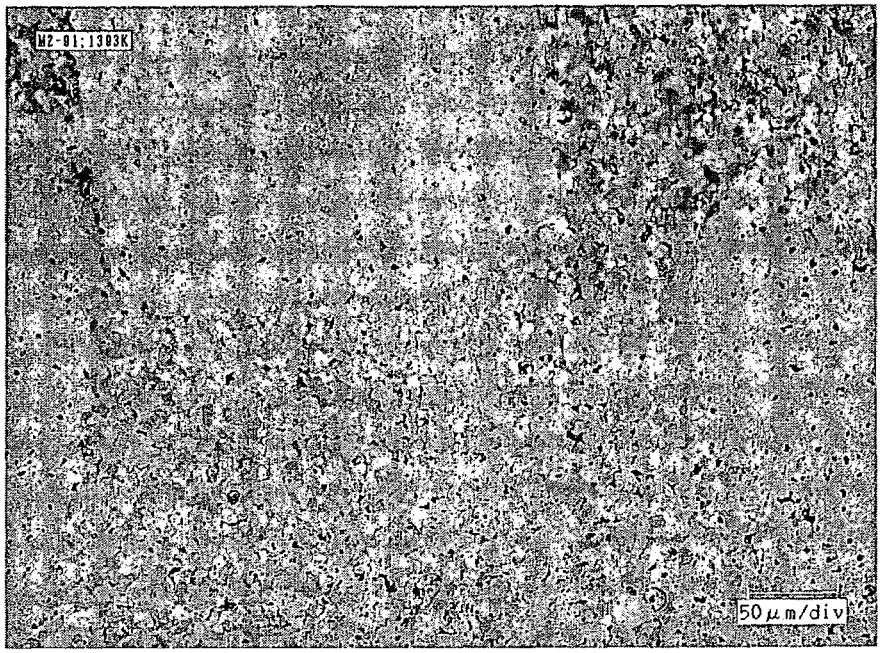
FIG. 5 is a photograph showing the metallographic structure of Sample No. 1 that had been sintered at 1,120° C. and then looked at through a polarizing microscope.
Figure 6:
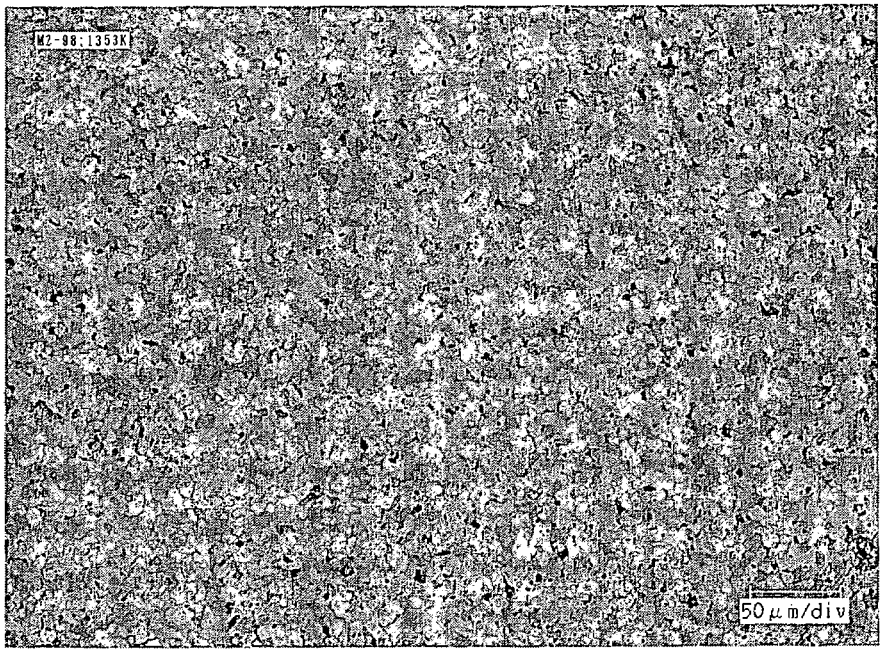
FIG. 6 is a photograph showing the metallographic structure of Sample No. 4 that had been sintered at 1,080° C. and then looked at through a polarizing microscope.
Figure 7:
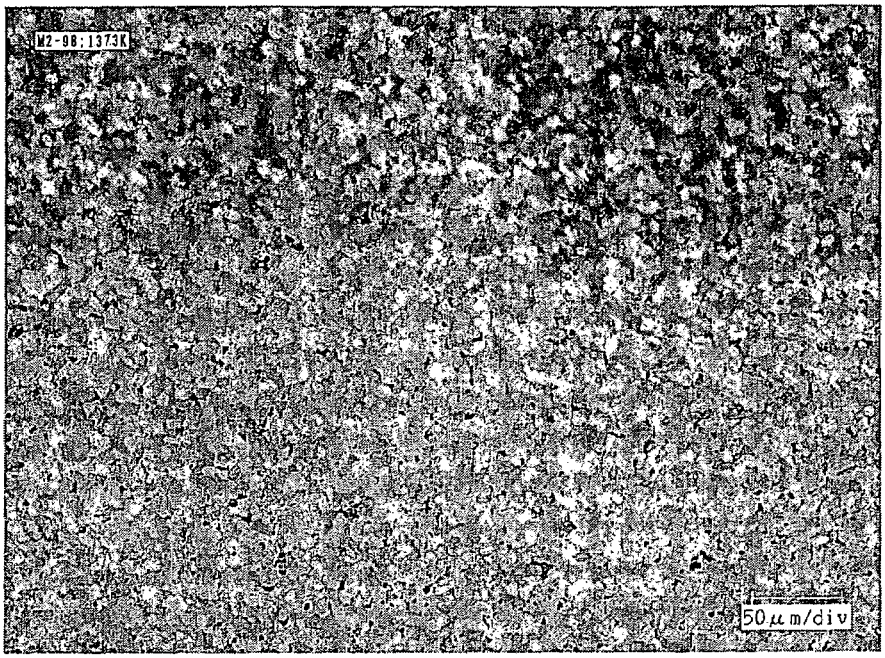
FIG. 7 is a photograph showing the metallographic structure of Sample No. 4 that had been sintered at 1,100° C. and then looked at through a polarizing microscope.
Figure 8:
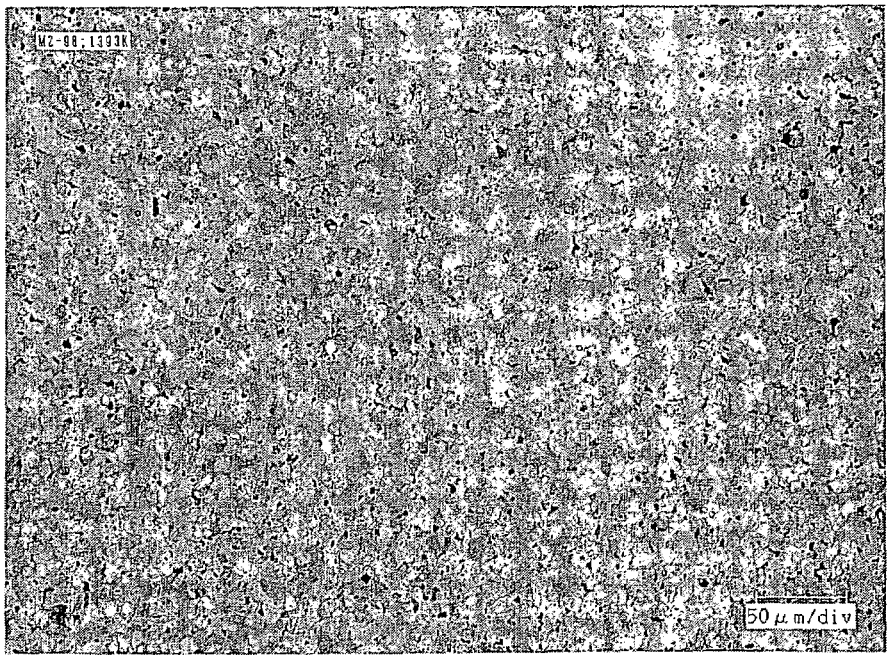
FIG. 8 is a photograph showing the metallographic structure of Sample No. 4 that had been sintered at 1,120° C. and then looked at through a polarizing microscope.
Figure 9:
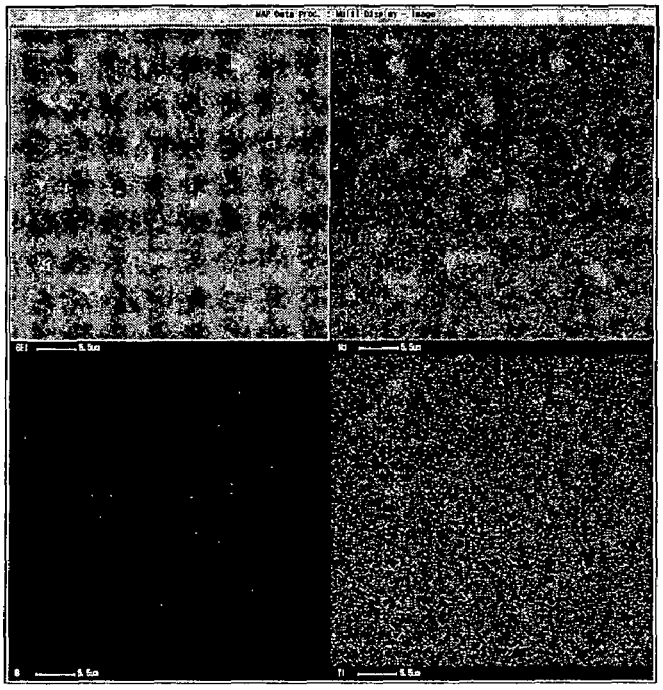
FIG. 9 shows the backscattered electron image (BEI) of the sintered magnet of Sample No. 2, composition images of Nd and B, and the image of an additive element Ti on the upper left, upper right, lower left and lower right portions, respectively, all of which were taken with an EPMA.
Figure 10:
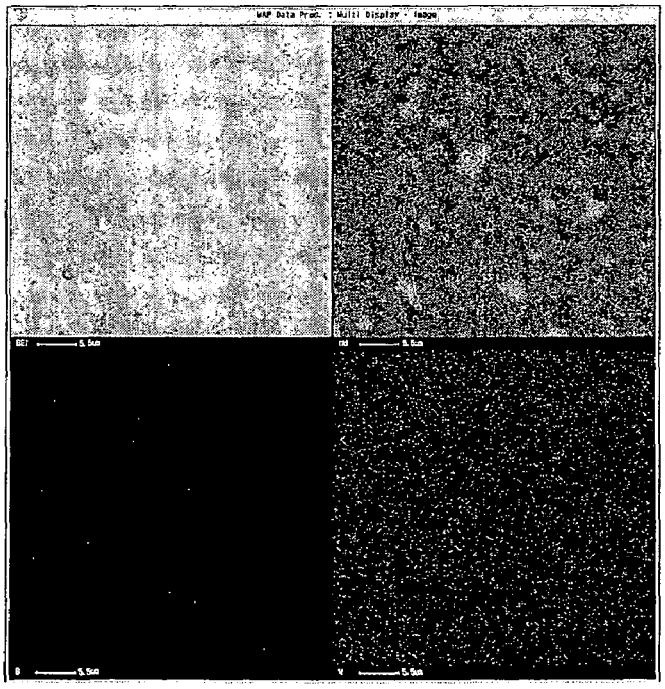
FIG. 10 shows the backscattered electron image (BEI) of the sintered magnet of Sample No. 3, composition images of Nd and B, and the image of an additive element V on the upper left, upper right, lower left and lower right portions, respectively, all of which were taken with an EPMA.
Figure 11:
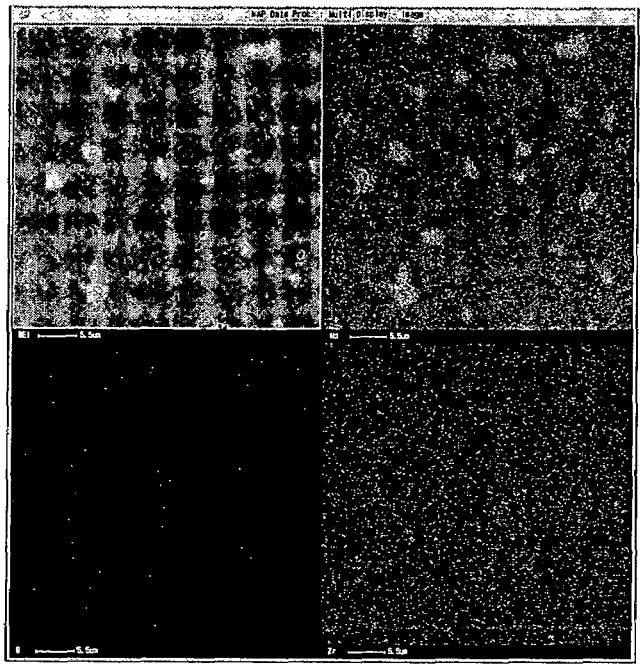
FIG. 11 shows the backscattered electron image (BEI) of the sintered magnet of Sample No. 4, composition images of Nd and B, and the image of an additive element Zr on the upper left, upper right, lower left and lower right portions, respectively, all of which were taken with an EPMA.
Figure 12:
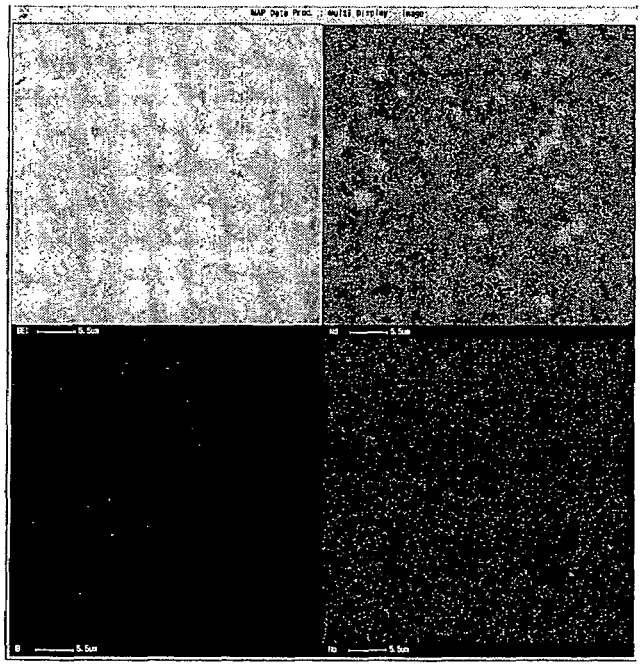
FIG. 12 shows the backscattered electron image (BEI) of the sintered magnet of Sample No. 5, composition images of Nd and B, and the image of an additive element Nb on the upper left, upper right, lower left and lower right portions, respectively, all of which were taken with an EPMA.
Figure 13:
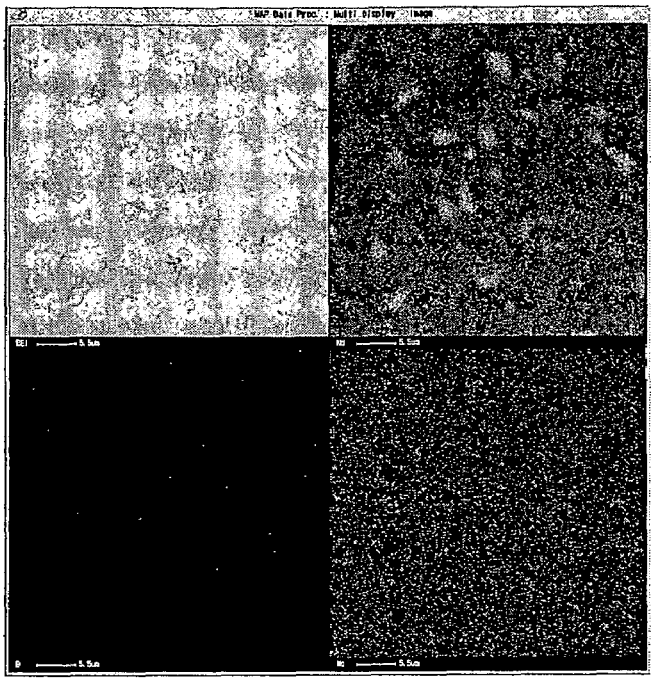
FIG. 13 shows the backscattered electron image (BEI) of the sintered magnet of Sample No. 6, composition images of Nd and B, and the image of an additive element Mo on the upper left, upper right, lower left and lower right portions, respectively, all of which were taken with an EPMA.

Next, referring to FIGS. 3 through 8, shown are the metallographic structures of Samples Nos. 1 and 4, which were sintered at different temperatures and then looked at through a polarizing microscope. Specifically, FIGS. 3, 4 and 5 show how Sample No. 1 looked like after having been sintered at 1,080° C., 1,100° C. and 1,120° C., respectively. On the other hand, FIGS. 6, 7 and 8 show how Sample No. 4 looked like after having been sintered at 1,080° C., 1,100° C. and 1,120° C., respectively.

As can be seen from FIG. 3, if Sample No. 1 was sintered at 1,080° C., no sign of abnormal grain growth was recognized but a good metallographic structure consisting of fine crystal grains was observed. If the sintering temperature was 1,100° C., however, a giant structure, produced by the abnormal grain growth, was already observed as can be seen from FIG. 4. And when the sintering temperature was raised to 1,120° C., a lot more giant structure was observed as shown in FIG. 5.

In Sample No. 4 with an additive Zr on the other hand, the abnormal grain growth was hindered as can be seen from FIGS. 6 through 8. Even if the sintering temperature was 1,120° C., virtually no giant structure was identified as shown in FIG. 8.

Next, referring to FIGS. 9 to 13, shown are the backscattered electron images (BEI) of the sintered magnets of Samples Nos. 2 through 6 (which were sintered at 1,040° C.), composition images of Nd and B, and the images of additive elements M on the upper left, upper right, lower left and lower right portions, respectively, all of which were taken with an EPMA. It can be seen that no accumulated phase (i.e., no segregation) of B was identified and no boride phase had been produced because each of these samples had a B mass fraction as low as 0.95 mass %. No accumulated phase of the additive element M (which is at least one of Ti, V, Nb and Mo) added at just 0.1 mass % was identified, either. However, segregation of Ti with a relatively small atomic weight was observed a little.

As can be seen from these results, no boride nucleates if the mass fraction of B is small and if a very small amount of additive element M is introduced. More importantly, the present inventors discovered that even without nucleating any boride, the abnormal grain growth could still be suppressed contrary to the common knowledge in the prior art that a boride should be included to impede the abnormal grain growth.

Figure 14:
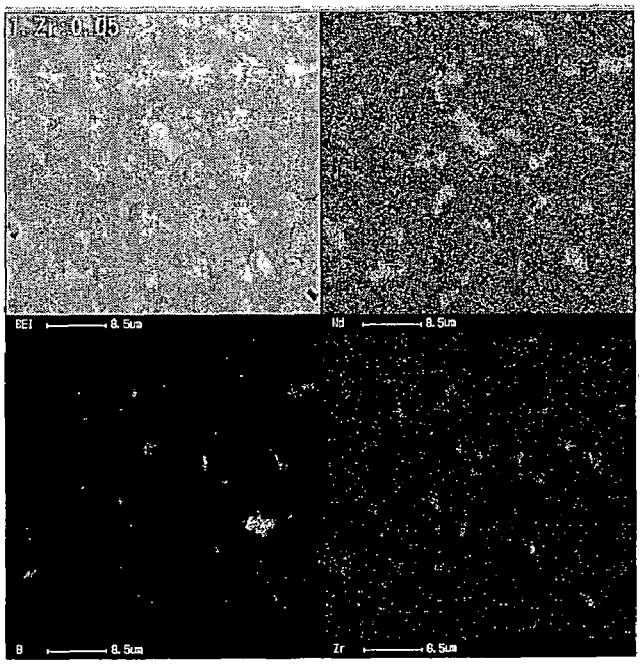
FIG. 14 shows the backscattered electron image (BEI) of the sintered magnet as a comparative sample, composition images of Nd and B, and the image of an additive element Zr on the upper left, upper right, lower left and lower right portions, respectively, all of which were taken with an EPMA.

For the purpose of comparison, a sintered magnet having a composition consisting of 31.3 mass % of R (including 20.3 mass % of Nd, 6.0 mass % of Pr and 5.0 mass % of Dy), 0.90 mass % of Co, 0.20 mass % of Al, 0.10 mass % of Cu, 0.07 mass % of Zr, 0.99 mass % of B, and Fe and inevitably contained impurities as the balance was also observed with an EPMA. The photos taken are shown in FIG. 14. As can be seen from FIG. 14, this sintered magnet including B at a high percentage had accumulated phases of Zr and B.

As described above, according to the present invention, by adding Zr to a composition including a small amount of B, the abnormal grain growth can be suppressed without producing any boride phase. Thus, an R-T-B based sintered magnet with increased remanence can be obtained by minimizing decreases in coercivity and the volume percentage of the main phase.

EXPERIMENTAL EXAMPLE NO. 2

Magnets having the compositions shown in the following Table 3 were produced by the same method as that used in Experimental Example No. 1. In this example, however, the concentration of oxygen in the atmospheric gas was controlled to 50 ppm or less in the fine pulverization process in order to reduce the content of oxygen in the resultant sintered magnet. These samples Nos. 7 through 20 prepared in this manner were sintered at various sintering temperatures, thereby obtaining sintered magnets, of which the properties were evaluated as shown in the following Table 4. In Table 4, each item was evaluated as in Experimental Example No. 1 described above.

TABLE 3

| Sample | Nd | Fe | Co | Al | Cu | Zr | Ga | B | O | C | N |
|---|---|---|---|---|---|---|---|---|---|---|---|
| No. 7 | 29.3 | Bal. | 0.88 | 0.16 | 0.09 | — | — | 1.02 | 0.22 | 0.06 | 0.011 |
| No. 8 | 29.4 | Bal. | 0.87 | 0.15 | 0.10 | — | — | 0.98 | 0.21 | 0.05 | 0.010 |
| No. 9 | 29.2 | Bal. | 0.88 | 0.15 | 0.09 | — | — | 0.96 | 0.22 | 0.06 | 0.010 |
| No. 10 | 29.2 | Bal. | 0.88 | 0.16 | 0.09 | — | — | 0.94 | 0.22 | 0.06 | 0.011 |
| No. 11 | 29.2 | Bal. | 0.89 | 0.16 | 0.10 | — | — | 0.90 | 0.21 | 0.07 | 0.010 |
| No. 12 | 29.3 | Bal. | 0.87 | 0.16 | 0.10 | 0.10 | — | 1.02 | 0.22 | 0.06 | 0.011 |
| No. 13 | 29.2 | Bal. | 0.90 | 0.15 | 0.10 | 0.08 | — | 0.99 | 0.22 | 0.06 | 0.010 |

TABLE 3-continued

| Sample | Nd | Fe | Co | Al | Cu | Zr | Ga | B | O | C | N |
|---|---|---|---|---|---|---|---|---|---|---|---|
| No. 14 | 29.1 | Bal. | 0.88 | 0.16 | 0.09 | 0.09 | — | 0.96 | 0.22 | 0.07 | 0.010 |
| No. 15 | 29.2 | Bal. | 0.89 | 0.16 | 0.09 | 0.09 | — | 0.93 | 0.21 | 0.06 | 0.011 |
| No. 16 | 29.2 | Bal. | 0.89 | 0.17 | 0.09 | 0.08 | — | 0.91 | 0.21 | 0.06 | 0.011 |
| No. 17 | 29.3 | Bal. | 0.88 | 0.12 | 0.10 | 0.09 | 0.04 | 0.97 | 0.22 | 0.05 | 0.009 |
| No. 18 | 29.3 | Bal. | 0.89 | 0.11 | 0.10 | 0.09 | 0.04 | 0.95 | 0.22 | 0.06 | 0.009 |
| No. 19 | 29.2 | Bal. | 0.89 | 0.14 | 0.10 | 0.08 | 0.04 | 0.93 | 0.21 | 0.06 | 0.010 |
| No. 20 | 29.3 | Bal. | 0.88 | 0.12 | 0.10 | 0.09 | 0.04 | 0.91 | 0.21 | 0.06 | 0.011 |

(unit: mass %)

TABLE 4

| | Accumulated phase | | 1,020° C. | | 1,040° C. | | 1,060° C. | | 1,080° C. | |
|---|---|---|---|---|---|---|---|---|---|---|
| Sample | B | Zr | Size | Hk/HcJ | Size | Hk/HcJ | Size | Hk/HcJ | Size | Hk/HcJ |
| No. 7 | ○ | — | ○ | 0.967 | ○ | 0.970 | ○ | 0.903 | x | 0.328 |
| No. 8 | ○ | — | ○ | 0.970 | ○ | 0.972 | x | 0.790 | x | 0.120 |
| No. 9 | ○ | — | ○ | 0.968 | ○ | 0.975 | x | 0.689 | x | 0.093 |
| No. 10 | x | — | ○ | 0.965 | ○ | 0.973 | ○ | 0.897 | x | 0.241 |
| No. 11 | x | — | ○ | 0.970 | ○ | 0.973 | x | 0.648 | x | 0.109 |
| No. 12 | ○ | ○ * | ○ | 0.968 | ○ | 0.972 | ○ | 0.972 | ○ | 0.964 |
| No. 13 | ○ | ○ * | ○ | 0.970 | ○ | 0.975 | ○ | 0.973 | ○ | 0.953 |
| No. 14 | ○ | ○ * | ○ | 0.972 | ○ | 0.973 | ○ | 0.971 | ○ | 0.933 |
| No. 15 | x | x | ○ | 0.968 | ○ | 0.973 | ○ | 0.974 | ○ | 0.940 |
| No. 16 | x | x | ○ | 0.968 | ○ | 0.974 | ○ | 0.974 | ○ | 0.934 |
| No. 17 | ○ | ○ * | ○ | 0.970 | ○ | 0.974 | ○ | 0.972 | ○ | 0.935 |
| No. 18 | x | x | ○ | 0.969 | ○ | 0.975 | ○ | 0.973 | ○ | 0.920 |
| No. 19 | x | x | ○ | 0.967 | ○ | 0.973 | ○ | 0.974 | ○ | 0.915 |
| No. 20 | x | x | ○ | 0.968 | ○ | 0.972 | ○ | 0.973 | ○ | 0.924 |

Legends:
in accumulated phase, x means that no accumulated phase was identified, ○ means that an accumulated phase was identified, and * means that accumulated phases of B and Zr coexisted; in size (particle size), ○ means that no abnormal grain growth occurred and x means that abnormal grain growth occurred.

As can be seen from the results shown in Table 4, the abnormal grain growth occurred no matter whether the B or Zr accumulated phase was present or not. It can also be seen that with the addition of Zr, the abnormal grain growth was suppressed, no matter whether the Zr accumulated phase was present or not.

When sintered at 1,020° C., each of these samples had a sintered density of 7.46 $Mgm^{-3}$ to 7.49 $Mgm^{-3}$, which shows that the sample had been sintered slightly insufficiently compared to a true density of about 7.55 $Mgm^{-3}$. On the other hand, if the sintering temperature was in the range of 1,040° C. to 1,080° C., the sintered density of every sample reached the range of 7.54 $Mgm^{-3}$ to 7.57 $Mgm^{-3}$. Thus, it can be seen that the sintering temperature of 1,020° C. resulted in insufficient sintering and non-negligibly low remanence.

That is why to avoid the abnormal grain growth and minimize the decrease in square ratio while achieving a sintered density that would cause only a negligible degree of decrease in remanence, 1,040° C. would be the only preferred sintering temperature for Samples Nos. 7 through 11, to which no Zr was added. Sample No. 7 had a square ratio of 0.9 or more, which is not preferable, either, because the values of Hk and HcJ were small. Meanwhile, as to Samples Nos. 12 through 20 including an additive Zr, the abnormal grain growth and decrease in square ratio were still minimum even at a sintering temperature of 1,080° C., and the preferred sintering temperature range shifted to 1,040° C. through 1,080° C., which was higher than that of Samples Nos. 7 through 11. Consequently, Samples Nos. 12 through 20 can be manufactured more constantly than Samples Nos. 7 through 11.

Figure 15:
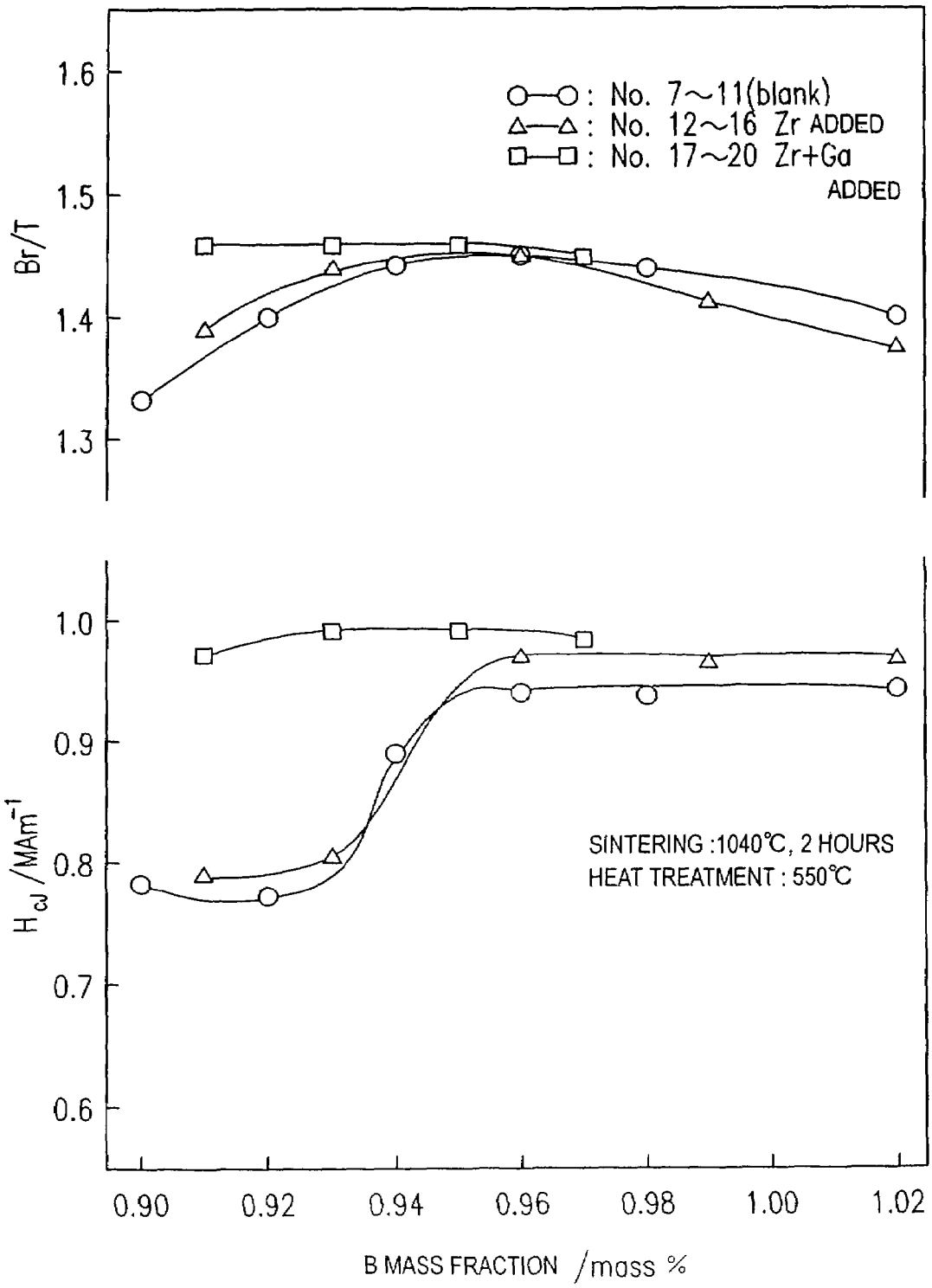
FIG. 15 is a graph summarizing how the magnetic properties of Samples Nos. 7 through 20 change with the mass fraction of B, where the abscissa represents the B mass fraction while the ordinate represents the remanence Br in the upper half and the coercivity HcJ in the lower half, respectively.

Next, it will be described with reference to FIG. 15 how magnetic properties change with the B mass fraction. FIG. 15 is a graph summarizing how the magnetic properties of Samples Nos. 7 through 20 change with the mass fraction of B, where the abscissa represents the B mass fraction while the ordinate represents the remanence Br in the upper half and the coercivity HcJ in the lower half, respectively.

As can be seen from FIG. 15, Samples Nos. 7 through 11 including no Zr has a peak remanence at a B mass fraction of around 0.96 mass %. This is because once the B mass fraction exceeds about 0.96 mass %, the B-rich phase (i.e., $Nd_{1.1}Fe_4B_4$ compound phase), not contributing to magnetism, increases. However, the coercivity is not affected by the B-rich phase and does not decrease even if the B mass fraction has exceeded about 0.96 mass %.

On the other hand, if the B mass fraction is smaller than about 0.96 mass %, then no B-rich phases are produced but an $Nd_2Fe_{17}$ phase nucleates. This $Nd_2Fe_{17}$ phase is a soft magnetic phase (whereas the main phase is a hard magnetic phase). That is why once the $Nd_2Fe_{17}$ phase has nucleated, the coercivity drops steeply. In addition, since the volume percentage of the main phase decreases due to the nucleation of the $Nd_2Fe_{17}$ phase, the remanence decreases, too.

Samples Nos. 12 through 16 including Zr have higher coercivity than Samples Nos. 7 through 11. However, if the B mass fraction is smaller than about 0.96 mass %, then the remanence thereof drops as steeply as in Samples Nos. 7 through 11. On the other hand, the remanence decreases once the B mass fraction has exceeded about 0.96 mass %. Particularly when the B mass fraction exceeds 0.98 mass %, the decrease in the remanence of Samples Nos. 12 through 16 becomes more significant than that of Samples Nos. 7 through 11 including no Zr. This is because if there is an excessive amount of B in a sample including Zr, then a Zr-containing boride phase such as $ZrB_2$, Zr—Nd—B or Zr—Fe—B will nucleate. That is to say, it can be seen that the addition of Zr improves the magnetic properties just indirectly, not directly, by suppressing the abnormal grain growth but rather decreases the remanence significantly in a composition range in which the B mass fraction exceeds 0.98 mass %.

In Samples Nos. 17 through 20 to which not only Zr but also an extremely small amount (e.g., 0.04 mass %) of Ga are added, the decreases in remanence and coercivity in the composition range in which the B mass fraction is smaller than 0.96 mass % can be eliminated, and the B mass fraction range that maximizes the remanence expands substantially in the low-fraction direction, thereby realizing a sintered magnet that has a broad sintering temperature range and excellent magnetic properties. These effects achieved by adding not only Zr but also Ga are noticeable when the B mass fraction is 0.95 mass % or less.

FIG. 15 shows the results obtained when the B mass fraction was 0.90 mass % or more. However, if the B mass fraction is at least equal to 0.85 mass %, those effects achieved by adding Zr and Ga in combination are noticeable. Nevertheless, it is still true that the B mass fraction is preferably 0.90 mass % through 0.98 mass % as described for this experimental example.

EXPERIMENTAL EXAMPLE NO. 3

Sintered magnets, having a composition consisting of 22.0 mass % of Nd, 6.2 mass % of Pr, 2.0 mass % of Dy, 1.8 mass % of Co, 0.10 mass % of Cu, 0.94 mass % of B, 0.05 mass % of Ga, X (0 to 4) mass % of Zr, and Fe and inevitably contained impurities as the balance, were produced at various sintering temperatures by the same method as that adopted in Experimental Example No. 1 and the magnetic properties thereof were evaluated. The sintered magnets produced in this Experimental Example No. 3 had an oxygen content of 0.38 mass % to 0.41 mass %.

Figure 16:
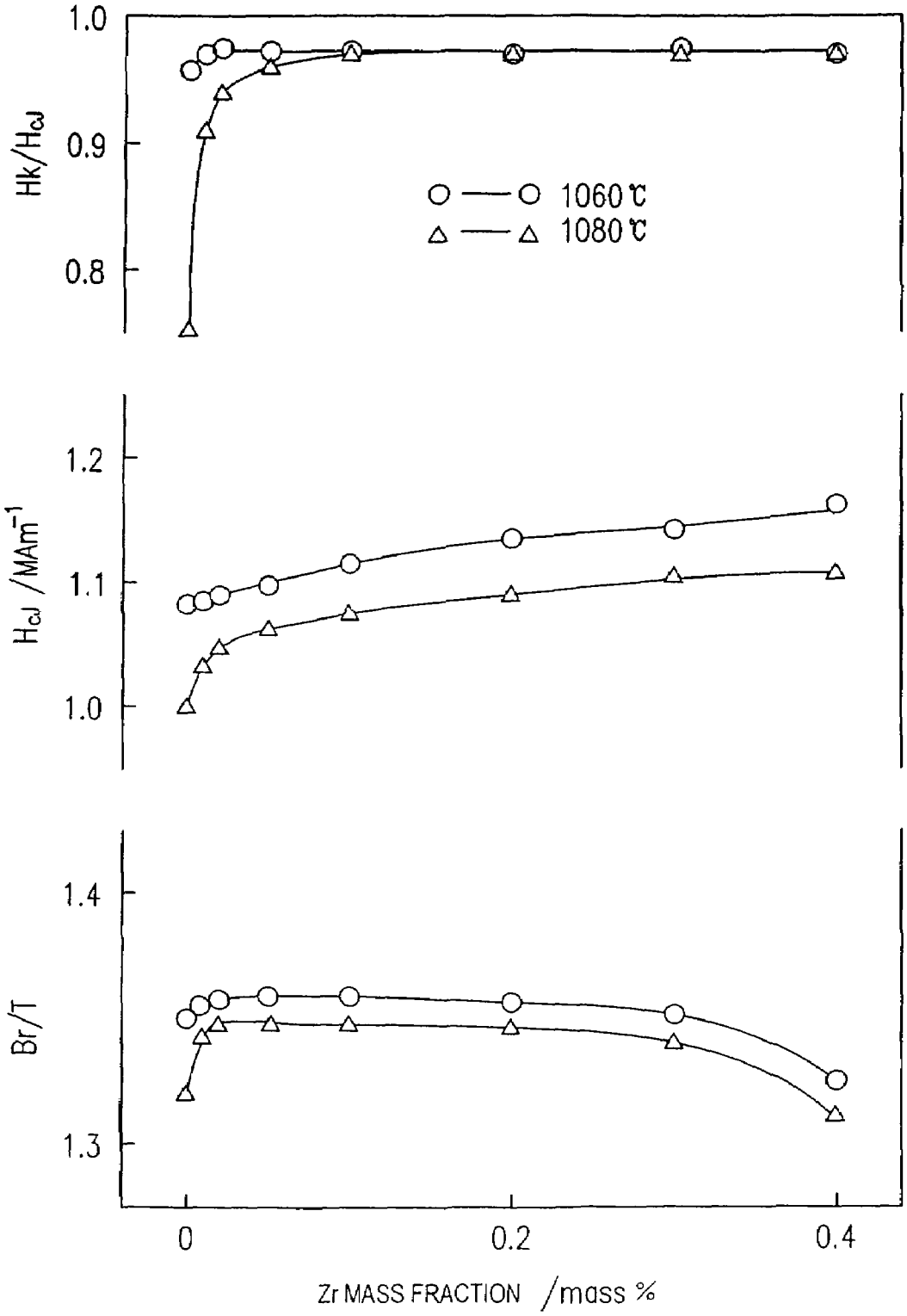
FIG. 16 is a graph showing how the magnetic properties changed with the mass fraction of Zr in two situations where the sintering temperatures were 1,060° C. and 1,080° C., respectively.

FIG. 16 is a graph showing how the magnetic properties changed with the mass fraction of Zr in two situations where the sintering temperatures were 1,060° C. and 1,080° C., respectively. In FIG. 16, the abscissa represents the Zr mass fraction, while the ordinate represents Hk (which is the strength of an external magnetic field when the magnetization becomes 90% of the remanence Br), coercivity HcJ and remanence Br in this order downward.

As can be seen from FIG. 16, even if the Zr mass fraction is as small as 0.01 mass %, the effect of improving the coercivity HcJ is still noticeable as long as the sintering temperature is high. However, once the Zr mass fraction exceeds 0.3 mass %, the remanence Br decreases steeply. Thus, it can be seen that the Zr mass fraction is preferably adjusted to 0.3 mass % or less.

According to the present invention, an R-T-B based sintered magnet can be obtained with the decrease in coercivity minimized and with the remanence increased. A rare-earth sintered magnet according to the present invention affords a wide margin for the sintering temperature and can be manufactured constantly on an industrial basis. A rare-earth sintered magnet according to the present invention can be used particularly effectively in an application that desperately needs high performance, as in various types of motors and actuators.

The invention claimed is:

1. A rare-earth sintered magnet, a main phase of which includes an $R_2T_{14}B$ type compound phase, the magnet comprising:

27 mass % through 32 mass % of R, which is at least one rare-earth element that is selected from the group consisting of Nd, Pr, Tb, and Dy and that always includes at least one of Nd and Pr;

60 mass % through 73 mass % of T, which is either Fe alone or a mixture of Fe and Co;

0.85 mass % through 0.98 mass % of Q, which is either B alone or a mixture of B and C and which is converted into B on a number of atoms basis when its mass percentage is calculated;

more than 0 mass % through 0.3 mass % of Zr;

at most 2.0 mass % of an additive element M, which is at least one element selected from the group consisting of Al, Cu, Ga, In and Sn; and inevitably contained impurities; wherein the additive element includes Ga, which accounts for 0.01 mass % through 0.08 mass % of the magnet.

2. The rare-earth sintered magnet of claim 1 comprising substantially no accumulated phases of Q.

3. The rare-earth sintered magnet of claim 1 comprising at most 0.95 mass % of Q.

4. The rare-earth sintered magnet of claim 3 comprising at least 0.90 mass % of Q.

5. The rare-earth sintered magnet of claim 1, wherein the magnet has a square ratio Hk/HcJ of at least 0.9 in its demagnetization curve.

6. A material alloy for a rare-earth sintered magnet, a main phase of which includes an $R_2T_{14}B$ type compound phase, the alloy comprising:

27 mass % through 32 mass % of R, which is at least one rare-earth element that is selected from the group consisting of Nd, Pr, Tb, and Dy and that always includes at least one of Nd and Pr;

60 mass % through 73 mass % of T, which is either Fe alone or a mixture of Fe and Co;

0.85 mass % through 0.98 mass % of Q, which is either B alone or a mixture of B and C;

more than 0 mass % through 0.3 mass % of Zr;

at most 2.0 mass % of an additive element M, which is at least one element selected from the group consisting of Al, Cu, Ga, In and Sn; and inevitably contained impureties; wherein the additive element includes Ga, which accounts for 0.01 mass % through 0.08 mass % of the magnet.

7. The rare-earth alloy of claim 6 comprising substantially no accumulated phases of Q.

8. The rare-earth alloy of claim 6, comprising at most 0.95 mass % of Q.

* * * * *